US010813528B2

(12) United States Patent
Chirumbolo et al.

(10) Patent No.: US 10,813,528 B2
(45) Date of Patent: Oct. 27, 2020

(54) AUTOMATIC DOOR FOR DISHWASHER WITH MULTI-POSITION SENSING

(71) Applicant: Illinois Tool Works Inc., Glenview, IL (US)

(72) Inventors: Dino Chirumbolo, Settimo Torinese (IT); Mark Jonathan Banfield, Colehill Wimborn (GB)

(73) Assignee: Illinois Tool Works Inc., Glenview, IL (US)

( * ) Notice: Subject to any disclaimer, the term of this patent is extended or adjusted under 35 U.S.C. 154(b) by 112 days.

(21) Appl. No.: 16/091,420

(22) PCT Filed: Apr. 18, 2017

(86) PCT No.: PCT/US2017/028113
§ 371 (c)(1),
(2) Date: Oct. 4, 2018

(87) PCT Pub. No.: WO2017/200680
PCT Pub. Date: Nov. 23, 2017

(65) Prior Publication Data

US 2019/0150701 A1 May 23, 2019

Related U.S. Application Data

(60) Provisional application No. 62/339,313, filed on May 20, 2016.

(51) Int. Cl.
*A47L 15/42* (2006.01)

(52) U.S. Cl.
CPC ..... *A47L 15/4259* (2013.01); *A47L 15/4263* (2013.01); *A47L 2401/26* (2013.01); *A47L 2501/22* (2013.01)

(58) Field of Classification Search
CPC ..... A47L 15/4259; A47L 15/4263; A47L 2401/26; A47L 2501/22
USPC ..... 134/56 D, 57 D, 57 DL, 58 D; 312/228
See application file for complete search history.

(56) References Cited

U.S. PATENT DOCUMENTS

2011/0279004 A1 11/2011 Assmann et al.

FOREIGN PATENT DOCUMENTS

EP 2845532 A1 3/2015

*Primary Examiner* — Levon J Shahinian
(74) *Attorney, Agent, or Firm* — Boyle Fredrickson, S.C.

(57) ABSTRACT

A dishwasher (10) provides a motorized latch element extending to open the dishwasher door (18) for venting according to sense positions. A robust rack and pinion mechanism driven by a DC motor (50) provides flexible positioning of the door for different applications while ensuring sufficient force to compress the dishwasher gasket for sealing.

18 Claims, 6 Drawing Sheets

AUTOMATIC DOOR FOR DISHWASHER WITH MULTI-POSITION SENSING

CROSS-REFERENCE TO RELATED APPLICATIONS

The present application claims the benefit of U.S. provisional application 62/339,313 filed May 20, 2016 and hereby incorporated by reference

FIELD OF THE INVENTION

The present invention relates to dishwashers for cleaning dishes and cutlery and more specifically to an automatic door for such dishwashers.

BACKGROUND OF THE INVENTION

A residential dishwasher may provide a washing chamber into which soiled dishes are placed and held by racks or the like. At the time of washing, the door to the chamber is closed and the dishes are sprayed with hot, soapy water. The door may include a gasket sealing the door against the chamber to prevent water leakage during the spraying process.

Properly compressing the door gasket may require considerable force. This force may be applied by a vigorous pressing against the door by the user or by a lever-action latch offering sufficient mechanical advantage to compress the gasket with the motion of a lever or the like. Such latches can be cumbersome to operate and require adjustment over time as they wear and the compliance of the gasket changes.

Just as it is desirable to seal the washing chamber during the washing process, it is desirable to vent the washing chamber when the dishes are drying. This venting may be accomplished through baffled ducts incorporated into the door passing moist air but preventing the passage of liquid water. Alternatively, electrically actuated shutters on door vents may open during the drying process. These latter electrically operated vents have the advantage that they may be closed during the washing cycle to reduce the transmission of noise into the kitchen. Vents suitable for this purpose are taught in co-pending U.S. Pat. No. 6,293,289 issued Sep. 25, 2001, and assigned to the assignee of the present invention and hereby incorporated by reference.

U.S. Pat. Nos. 7,731,806 and 7,654,590 also assigned to the assignee of the present application and hereby incorporated by reference, describe an alternative venting system that uses an automatic door opening device to crack the dishwasher door open after completion of the washing cycle to greatly improve interior venting.

SUMMARY OF THE INVENTION

The present invention provides a mechanism for opening a dishwasher door that provides a multipoint position sensing of a plunger position providing increased versatility for use in different dishwasher models and allowing the actuator to be used for user input by sensing slight displacements of the actuator when the user moves the dishwasher door. Improved position sensing further allows implementation of a "soft close" feature, for example, reducing risk of damage to entrapped cutlery or the like. In addition the actuator may provide for door contact sensing ensuring correct engagement of the door before closing (in some embodiments) and providing additional user-input by sensing when the consumer opens the dishwasher door after venting all.

Specifically, in one embodiment, the invention provides a dishwasher having a washing chamber with a door movable from an open position permitting the loading of the washing chamber along an axis, through a vent position providing venting but not loading of the washing chamber, to a sealed position sealing water within the washing chamber by the compression of a gasket. An electric actuator is at an upper wall of the washing chamber and has a movable plunger having an elongate section extendable to move the door to the vent position, the elongate section supporting a gear rack. A DC motor communicates through at least one pinion gear with the gear rack to move the plunger along the axis in a first and second direction with different polarities of electrical current applied to the DC motor to move the door to the vent position and retract the latch to the scaled position.

It is thus a feature of at least one embodiment of the invention to provide for a mechanically simple actuator for automatically opening a dishwasher door during the drying cycle for improved drying. The use of a DC motor and rack and pinion eliminates the need for complex linkages or the like allowing bidirectional motion to a variety of positions at different amounts of extension.

The plunger may include a latch portion engaging a corresponding latch portion on the door when the door is at the vent position to releasably engage the door to pull the door from the vent position to the sealed position with retraction of the latch to the sealed position.

It is thus a feature of at least one embodiment of the invention to permit the actuator to also pull the door closed against the force of the gasket substantially reducing effort required by the user in properly sealing the dishwasher.

The door may include a handle for disengaging the door from the first end of the plunger by activation of the handle.

It is thus a feature of at least one embodiment of the invention to allow the door to be opened at any time by the user. The dishwasher may further include an encoder providing a signal distinguishing a position of the electric actuator among at least three different positions of: the vent position, the sealed position, and a compressed-sealed position with the gasket further compressed from the sealed position.

It is thus a feature of at least one embodiment of the invention to permit arbitrary positioning of the plunger through the use of a general-purpose position encoder operating in conjunction with the controller (as opposed to hard limit switches). It is another feature of at least one embodiment of the invention to permit detection of a compressed-sealed position such as may provide input from the user indicating a desire to access the sealed wash cavity.

The encoder may provide at least one encoding track extending along the elongate section to interact with at least one stationary sensor.

It is thus a feature of at least one embodiment of the invention to incorporate a portion of the encoder into the plunger itself for reduced costs and improved positional accuracy.

The plunger may include a first and second parallel encoding track interacting with a first and second stationary sensor to provide two separate binary signals, combinations of which uniquely indicate the three different positions. The sensors may be light sensors sensing amount of light varied by the encoding tracks or mechanical switch is activated by the encoding tracks.

It is thus a feature of at least one embodiment of the invention to permit the use of robust binary type sensors to provide multiple position sensing.

The door may include a stop pressing the plunger inward when the door moves from the sealed position to the compressed-sealed position.

It is thus a feature of at least one embodiment of the invention to permit the user to press inward on the door and to sense this inward pressing as an input signal from the user.

The DC motor may communicate with the pinion gear through a gear train including at least one additional gear and the gear train may provide a mechanical play allowing movement of the elongate section without rotation of the DC motor by an amount equal to the distance between the sealed position and the compressed-sealed position.

It is thus a feature of at least one embodiment of the invention to permit the door to be moved inward from the sealed position without additional resistance from the gear train and DC motor.

The dishwasher may include a controller receiving signals from the encoder to respond to a detection of the electric actuator being in the compressed-sealed position to extend the electrical actuator plunger to move the door to the vent position.

It is thus a feature of at least one embodiment of the invention to provide a simple method of controllably opening the dishwasher door through the use of the plunger as a sensor.

The DC motor may be a synchronous DC motor operating at voltages of less than 24 volts.

It is thus a feature of at least one embodiment of the invention to provide an actuator using a simple and low-cost DC motor allowing reversibility without complex mechanisms.

The DC motor may operate to provide at least 40 Newtons of force on the plunger in compressing the gasket.

It is thus a feature of at least one embodiment of the invention to eliminate a need for the user to provide gasket compressing forces in closing the dishwasher door.

The dishwasher may further include a door engagement sensor sensing a contact between the plunger and the door.

It is thus a feature of at least one embodiment of the invention to permit automatic door closure by ensuring proper engagement between the plunger and the door for activating the dishwasher for cleaning.

These particular objects and advantages apply to only some embodiments falling within the claims, and thus do not define the scope of the invention.

DETAILED DESCRIPTION OF THE PREFERRED EMBODIMENT

Figure 1:
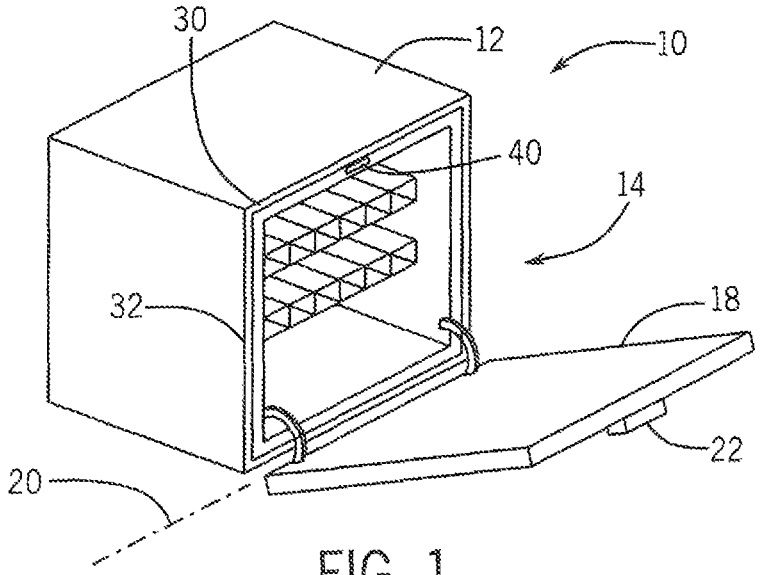
FIG. 1 is a perspective view of a dishwasher suitable for use with the present invention showing a door opening to reveal a washing chamber.

Referring now to FIG. 1, a dishwasher 10 includes a housing 12 partially enclosing a washing chamber 14, the latter holding racks 16 for suspending dishes and cutlery in the washing chamber 14. An open side of the washing chamber may be covered by a door 18 hinged to the housing 12 at a lower edge along a horizontal hinge axis 20. An upper edge of the door 18 may open a long tangent axis 19. A front surface of the door 18 may include a door release lever 22.

Figure 2:
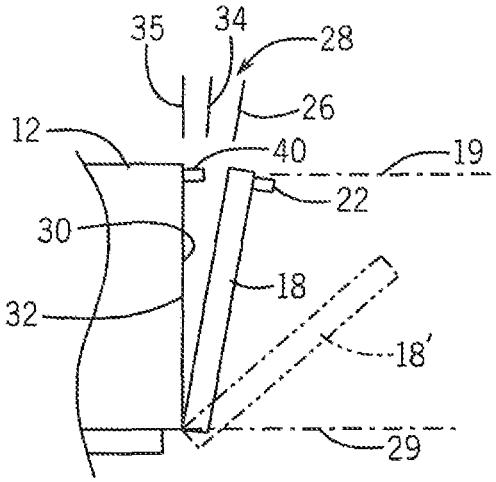
FIG. 2 is a side elevational view of the door of FIG. 1 showing closing of the door to a closed position in which the door is spaced from the washing chamber to provide a venting space.

Referring to FIG. 2, the door 18 may swing between an open position 29 shown in phantom and a vent position 26, in which the door 18 visually covers the washing chamber 14 but in fact is slightly displaced from a front lip 32 of the washing chamber 14 to provide a venting gap 28. The venting gap 28 may be, for example, may be as little as a ¼-inch gap between the rear face of the door 18 and a gasket 30 or maybe several inches from the gasket 30, the latter providing a seal between the door 18 and front lip 32 of the washing chamber 14. In one embodiment an excursion of 30 millimeters and at least 20 millimeters can be obtained. The door 18 may move further inward to a sealed position 34 compressing the gasket 30 to prevent water from leaking out of the washing chamber 14 and may move even further inward from the sealed position 34 to an actuation position 35. The actuation position 35 may be realized by a pressing inward by a user on the door 18 to further compress the gasket 30 beyond the point of sealing and serves to provide a mechanism through which the user can indicate a desire to open the door when the doors in the sealed state.

The door 18 may move between the vent position 26 and the sealed position 34 by operation of a plunger 40 as will be described below. When the door 18 is in the vent position 26, the venting gap 28 provides a passage for moist air 38 between the front lip 32 of the door 18 and gasket 30 at the conclusion of the washing cycle, before a resumption of the washing cycle, when the washing cycle is interrupted, and during periods when the dishwasher 10 is not in use.

While the venting gap 28 is relatively narrow, the effective open area for free ventilation in and out of the washing chamber 14 is substantial to provide improved ventilation over that normally obtained with through-door vents. Further, this total area of venting may be easily increased with only a minor increase in venting gap 28. By opening the door to vent the washing chamber, the space normally needed for a venting mechanism, and in particular for automatic vents that open and close to control sound emissions, can be freed for other use.

Figure 3:
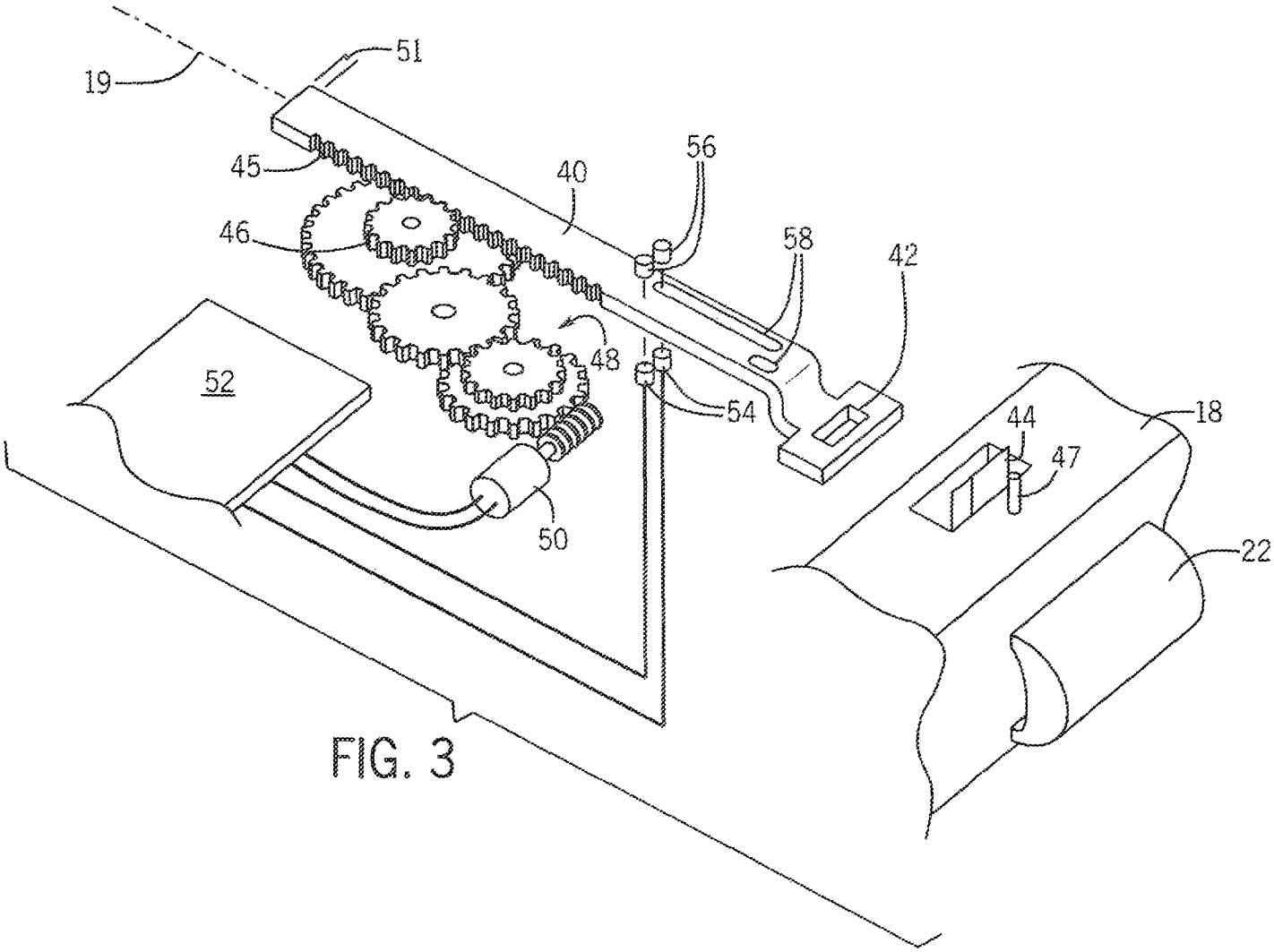
FIG. 3 is a simplified view in phantom of a plunger system for the present invention for opening and closing the door of FIG. 2.

Referring now to FIG. 3, plunger 40 may provide, at its distal end, a hasp eye 42 that may be captured by spring-loaded tooth 44 extending upward from an upper edge of the door 18 and retractable by pulling on the lever 22. In this way, the plunger 40 may releasably attach to the door 18 both for the purpose of extending the door 18 and retracting the door 18 against the gasket 30. Outward from the spring-loaded tooth 44 may be a stop surface 47, for example, an upwardly extending pin that abuts an outermost edge of the hasp eye 42 when the hasp eye 42 is captured by the spring-loaded tooth 44. This stop surface 47 allows pressure inward on the door 18 by the user to be transmitted to the hasp eye 42 and thus to the plunger 40 and for corresponding movement of the plunger 40 inward with movement inward of the door 18. This inward movement will be used to signal a desire by the consumer to open the door 18 when the door is in the sealed position 34 (shown in FIG. 1).

One side of a proximal end of the plunger 40 may provide for a rack gear 45 engaging with a rotatable pinion 46, the latter of which may be rotated by a gear train 48 providing increased mechanical advantage and driven by a small DC motor 50. The DC motor 50, for example, may operate at a low voltage (e.g., 12 volts) in a reversible manner to both extend and retract the plunger 40 and may provide sixty Newtons of force and preferably at least forty Newtons of force on the door for closure.

Figure 11:
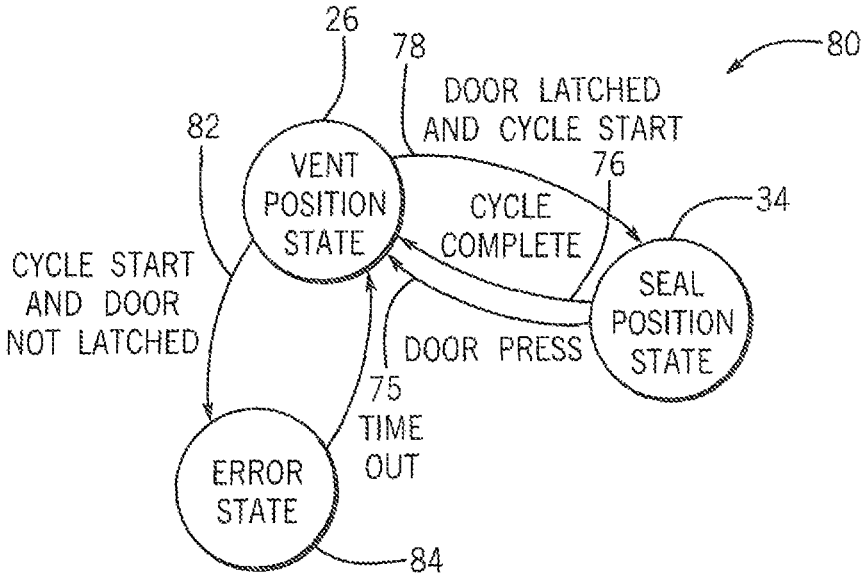
FIG. 11 is a state diagram of a program executed by the controller of FIG. 3 in controlling the plunger system.

The DC motor 50 may be driven by a control circuit 52 providing, for example, a microcontroller executing a stored program 80 (shown in FIG. 11) held in electronic memory as is generally understood in the art and providing or communicating with a dishwasher controller (not shown) controlling other operations of the dishwasher through multiple cycles of washing rinsing and drying. In addition, the control circuit 52 may receive signals from the photodetectors 54 operating in conjunction with light sources 56 (e.g., infrared LEDs) to sense the position of the plunger 40 by means of encoder tracks 58 cut through the surface of the plunger 40. These encoder tracks 58 are configured to selectively obscure and/or pass light between the photodetectors 54 and light sources 56 so as to provide signals indicating the position of the plunger 40.

Figure 4A:
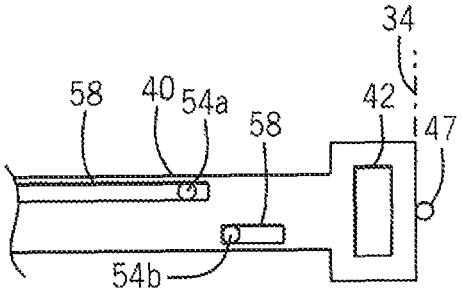
FIGS. 4*a-c* are fragmentary top plan views of the plunger in three positions showing position detection using encoder tracks incorporated into the plunger and read by LED/photodetector pairs.
Figure 4B:
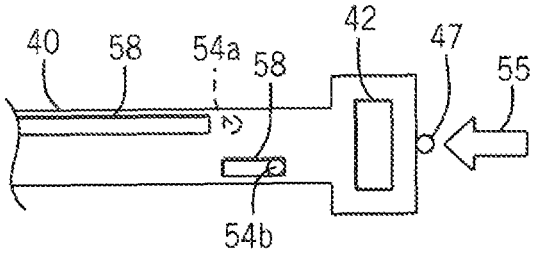
Figure 4C:
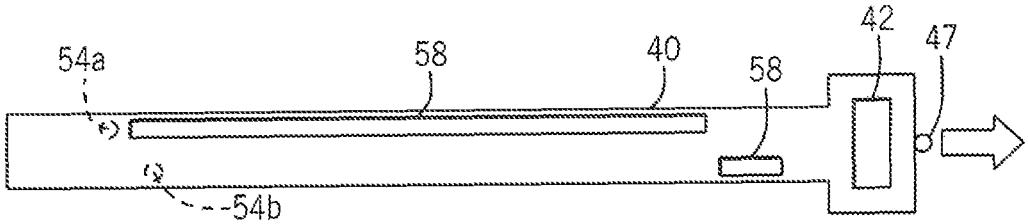

Referring now also to FIGS. 4*a-c* and FIG. 11, when the plunger 40 and door 18 are at the sealed position 34, photodetectors 54*a* and 54*b* both receive light through encoder tracks 58 signaling that the door 18 is in the sealed position to the control circuit 52. In the sealed position 34, the control circuit 52 controls other mechanisms of the dishwasher 10 controlling water valves and heaters and pumps to implement a standard dishwasher cleaning cycle of washing rinsing and drying. Pressure inward on the door 18 at any time moves the plunger 40 as indicated by arrow 55 (in FIG. 4*b*) inward to actuation position 35 made possible by slight compliance by the gasket 30 and some intentional play in the gear train 48, for example, by more than one quarter inch or preferably more than ⅛ inch. This movement causes photodetector 54*a* only to be blocked by its encoder track 58 signaling to the dishwasher 10 that the consumer desires to open the door. The control circuit 52 then stopped activation of the pump and heater, stalling the cycle, and activates the motor 50 to extend the plunger as indicated by FIG. 4*c* (and by state transition arrow 75 in FIG. 11) opening the door 18. In this way, the ability to sense a location of the plunger 40 allows the plunger location to be used as an additional user interface to the consumer.

This extension ceases when both photodetectors 54*a* and 54 are covered by the respective encoder tracks 58 and the door is in the vent position 26. The vent position 26 may also be realized at the end of the complete washing cycle as indicated by state transition arrow 76 where the vent position 26 is used for improving drying of the dishes.

In the vent position 26 may be the normal state of the dishwasher when it is not in use, holding the door 18 in the vent position or allowing it to be opened fully to the open position 29 for access to the wash cavity for loading or unloading dishes. When it is desired to wash a load of dishes, the user closes the door to the vent position 26 allowing the eye 42 to engage the tooth 44 (shown in FIG. 3) and presses a cycle start button (not shown). This causes the door to close to the sealed position 34 as indicated by state transition arrow 78.

If the door 18 is not engaged with the plunger 40 (sense by any of the means discussed with respect to FIGS. 6 and 7 below) and the cycle start button is pressed as indicated by state transition arrow 82, an error code will be provided to the user indicated by state 84, for example, by set of tones emitted by the control circuit 52 using APs or electric transducer or the like. This error state 84 does not entail any movement of the door. The vent state of position 26 is resumed after a brief time period.

It will be appreciated that the position sensing of the plunger 40, provided by encoder tracks 58 interacting with the photodetectors 54, also allows control of the plunger extension distance for venting (by opening the door 18 to the vent position 26) and for retracting the plunger 40 (for example, after the door is fully opened to position 18' shown in FIG. 1). The encoding of the encoder tracks 58 may employ a Gray code to avoid ambiguity in position at transitions between the encoder tracks 58 passing light and blocking light with the respective photodetectors 54.

Figure 5:
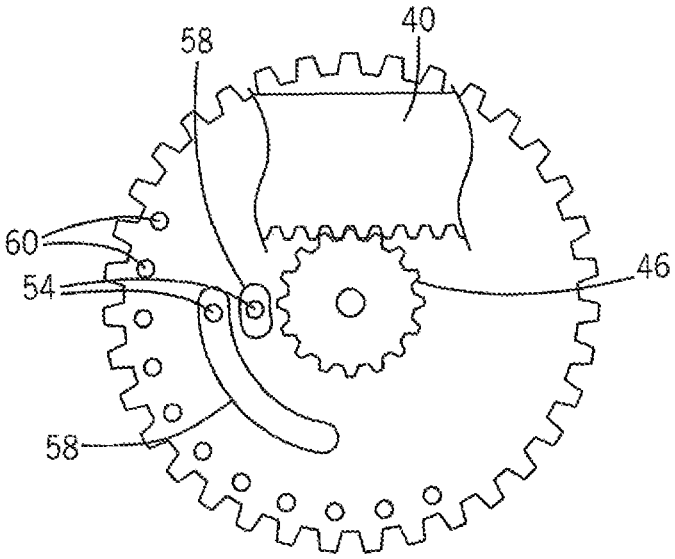
FIG. 5 is a top plan view of a pinion gear communicating with the rack on the plunger showing an alternative location for encoder tracks.

Referring now to FIG. 5, it will be appreciated that in addition or alternatively to placement of encoder tracks 58 on the plunger 40, these encoder tracks 58 may be placed on the pinion 46 which moves in tandem with the plunger 40. In this case, additional incremental tracks 60 may also be provided that provide a regular pulse stream indicating velocity of movement of the plunger 40. This allows the control circuit 52 to control and change the velocity of extension and retraction of the plunger 40, for example, as a function of its position, to provide a "soft close" in which the speed of closure slows as the motor compresses the gasket or the speed of opening slows as the door approaches its full extension with speed increasing between these points. This feature can be used to provide improved sensitivity to possible door blocking as the door is closed or opened.

Figure 6:
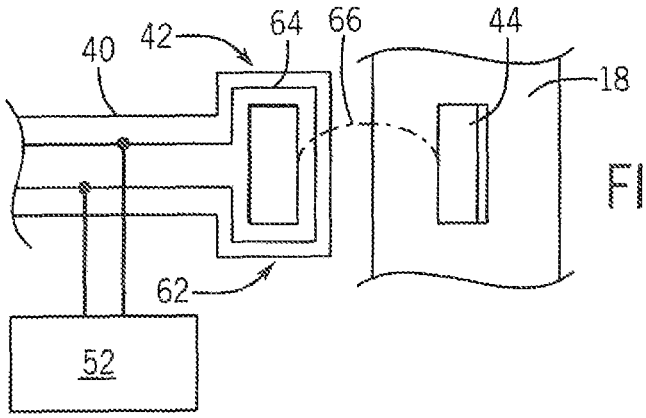
FIG. 6 is a simplified enlarged view of an end of the plunger showing a sensor for detecting contact between the plunger and the door.

Referring now to FIG. 6, the plunger 40 may incorporate a door contact sensor 62 providing a signal that the plunger 40 is in contact with the door 18. This signal is useful in ensuring that the door 18 is present (hence fully closed) when the plunger 40 is retracted but can also be used to provide an additional point of consumer input, for example, detecting when the door 18 has been pulled away from the plunger 40 by the consumer, for example, signaling that the plunger 40 should be retracted out of the way. In one embodiment, the door contact sensor 62 may be a wire loop 64, for example, in-molded into the thermoplastic material of the plunger 40 and encircling the opening of the hasp eye 42. Door contact can be determined, for example, by detecting capacitive or inductive coupling 66 between the loop 64 and metal materials of the door 18, for example, using known detection techniques implemented by circuitry on the control circuit 52.

Figure 7:
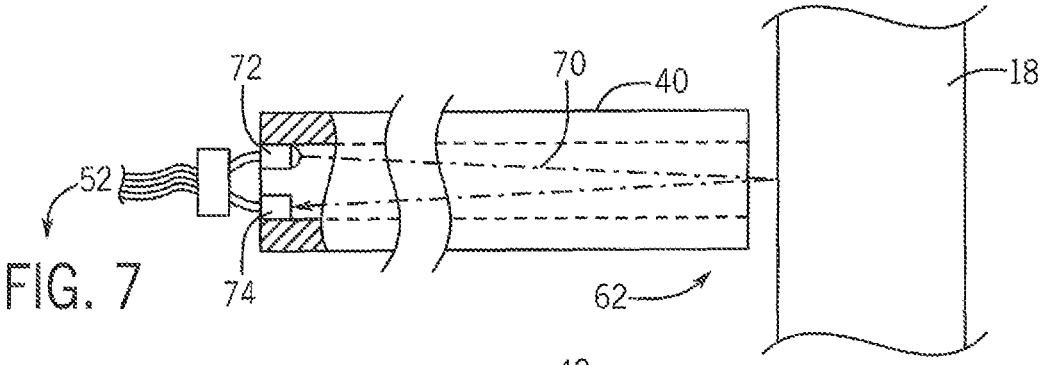
FIG. 7 is a figure similar to FIG. 6 showing an alternative plunger embodiment not providing a latching to the door and using an included light pipe for door contact sensing.

Referring now to FIG. 7, in an alternative embodiment, the plunger 40 may not have a hasp eye 42 but may serve simply to push the door 18 outward, for example, under the force of returning spring. In this embodiment, the user would compress the door 18 against the gasket 30 and there would be a separate latch holding the door in that position that could be released electrically to allow the plunger 40 to operate.

As also shown in this figure, an alternative door contact sensor 62 may be provided making use of a light pipe 70 integrally molded into the plunger 40 to conduct light from a photo emitter 72 along the light pipe to the distal end of the plunger 40 to be reflected off of the door 18 (if the door is in contact with the plunger 40), this reflection being detected by a photodetector 74 as monitored, for example, by the control circuit 52. Again, detection of the presence of the door 18 may be used to signal retraction of the plunger 40 when the door 18 is fully opened by the consumer. Other types of door sensors are contemplated including mechanical switches.

It will be appreciated that by adjusting the encoder tracks and number of photodetectors (for example, as shown in FIG. 4), additional positions of the plunger 40 may be monitored and thus the plunger 40 may be controllably located at these different positions. For example, the plunger 40 may be positioned at a sealed position 34 or vent position 26 or a closed position in between these positions, aesthetically closing the dishwasher without compressing the gasket to preserve gasket shape.

Figure 8:
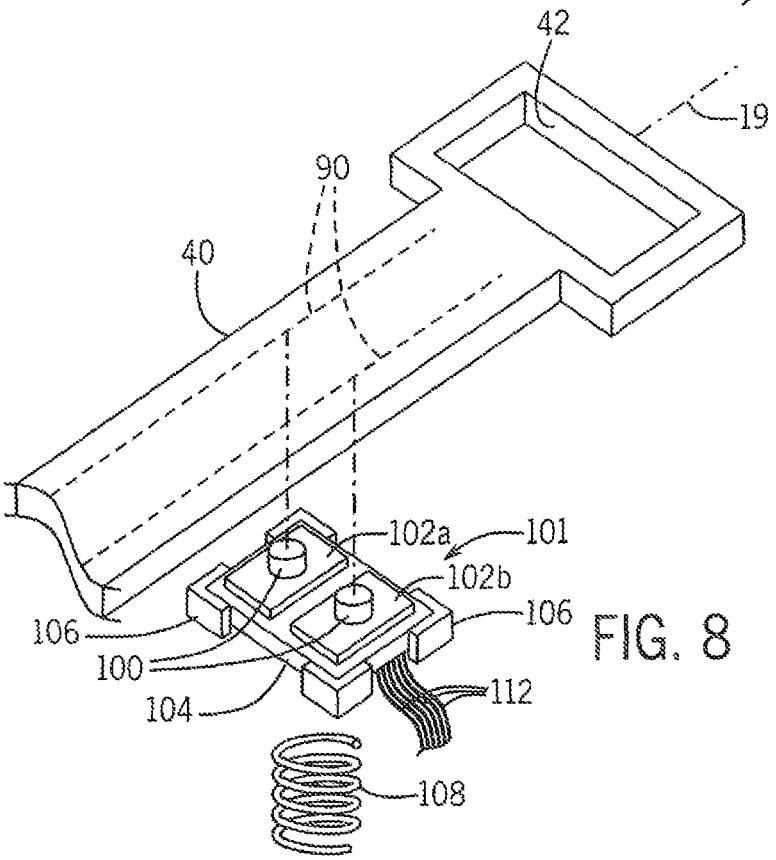
FIG. 8 is a figure similar to FIG. 3 showing an alternative sensor encoder system using mechanical switches.
Figure 9A:
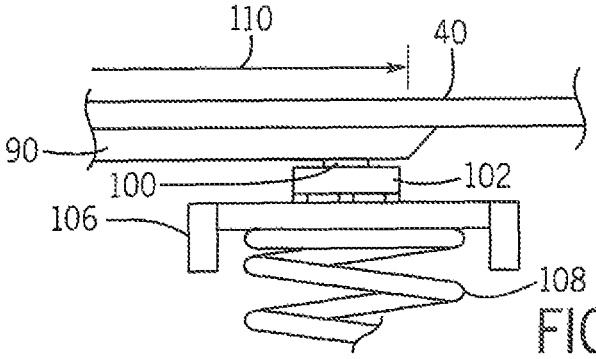
FIGS. 9*a* and 9*b* are side elevational fragmentary views of the plunger and mechanical switches of FIG. 8 showing a downwardly extending ridge that activates the switches as a function of position of the plunger.
Figure 9B:
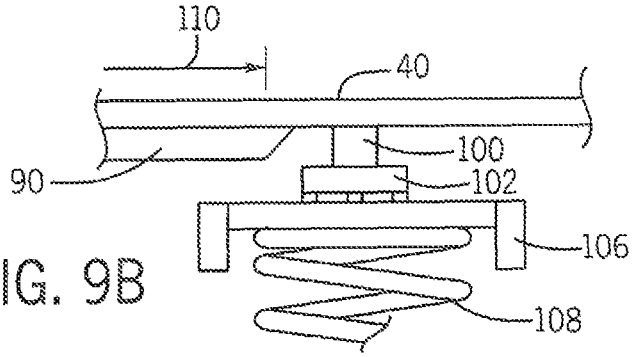

Referring now to FIGS. 8, 9*a*, and 9*b*, in an alternative embodiment, an under surface of the plunger 40 may provide for downwardly extending ribs 90 arranged into parallel tracks extending along axis 19 to contact pushbutton operators 100 extending upward from a switch array 101 position beneath the plunger 40. In this regard the switch array 101 includes a first and second momentary contact, single pole single throw pushbutton 102*a* and 102*b* arranged in side-by-side configuration along an axis perpendicular to axis 19. The pushbuttons one or two may be mounted on a circuit card 104 held by guides 106 to move upward Lee and downwardly without rotation under the force of compression spring 108 such as removes undesired between the operators 100 and the ribs 90 caused by manufacturing tolerances. The force of the spring 108 is such as to move the pushbutton operators 100 in contact with the ribs 90 without actuating those pushbuttons except in an active region 110 of the plunger 40 where the ribs 90 exist accordingly, as shown in FIG. 9*a*, the pushbutton 102 will be activated by the rib 90, whereas as shown in FIG. 9*b*, in a region where the ribs 90 do not exist, the pushbutton one or two will not be activated by the under surface of the plunger 40.

Figure 10A:
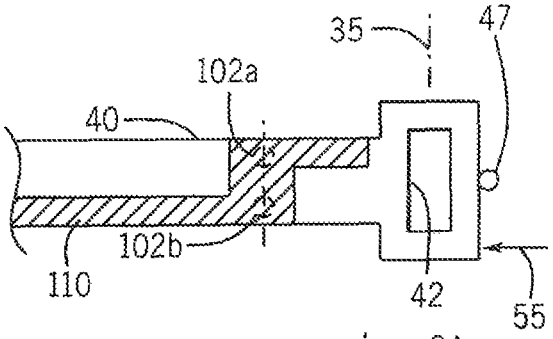
FIGS. 10*a-c* are figures similar to FIGS. 4*a-c* showing activation of the mechanical switches of FIG. 8 with different extensions of the plunger.
Figure 10B:
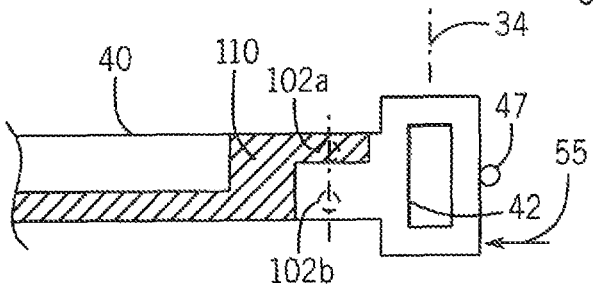
Figure 10C:
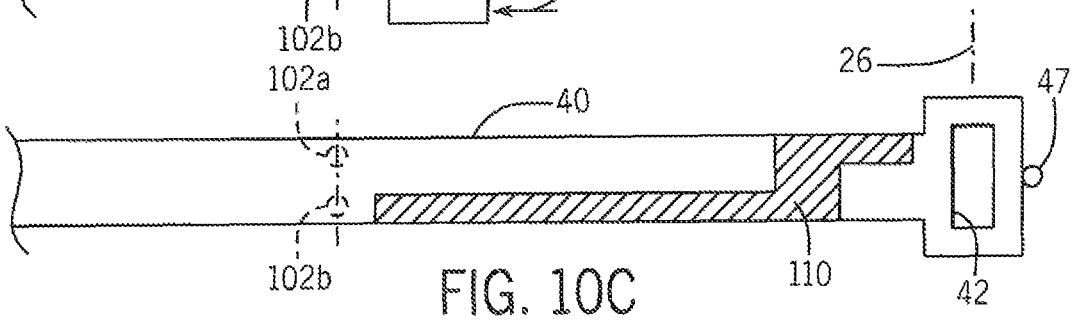

Referring now to FIGS. 10*a*-10*b*, when the plunger 40 and door 18 are at the sealed position 34, pushbuttons 102*a* and 102*b* are both activated by ribs 90 in active regions 110 indicated by crosshatch shading. Switches may be wired in parallel to a power or ground supply and then provide separate leads for each switch so that the switch states may independently be determined with only three conductors 112 shown in FIG. 8.

Pressure inward on the door 18 at any time moves the plunger 40 as indicated by arrow 55 (in FIG. 10*b*) inward to actuation position 35 made possible by slight compliance by the gasket 30 and some intentional play in the gear train 48 as discussed above. This movement causes pushbutton 102*a* only to be activated a rib 90 signaling to the dishwasher 10 that the consumer desires to open the door.

This extension ceases when both pushbuttons 102*a* and 102*b* are removed from the active area 110 and thus not activated by ribs 90 and the door 18 is in the vent position 26.

In addition, being able to sense a position of the plunger 40 allows the plunger to be used to detect, for example, a pulling on the door when it is in the sealed position indicating the consumer desires to open the door. Controlling the plunger to multiple positions allows control of different amounts of venting to be provided by different amounts of opening of the door depending on a deduced load or selected cycle of the dishwasher 10. The ability to operate with different appliances requires simply changing the length of the plunger 40 and adjusting the encoder tracks 58 allowing the system to be used with a variety of different appliance models and sizes.

Various features of the invention are set forth in the following claims. It should be understood that the invention is not limited in its application to the details of construction and arrangements of the components set forth herein. The invention is capable of other embodiments and of being practiced or carried out in various ways. Variations and modifications of the foregoing are within the scope of the present invention. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. A dishwasher comprising:

a washing chamber having a door movable from an open position permitting a loading of the washing chamber along an axis, through a vent position providing venting but not loading of the washing chamber, to a sealed position sealing water within the washing chamber by a compression of a gasket;

an electric actuator supported at an upper wall of the washing chamber, the electric actuator having a movable plunger:

having a plunger elongate section extendable to move the door to the vent position, the plunger elongate section supporting a gear rack; and providing an encoder on the plunger elongate section;

a sensor system interacting with the encoder to determine a position of the door as a function of an amount of extension of the plunger; and a DC motor communicating through at least one pinion gear with the gear rack to move the plunger along the axis in a first and second direction with different polarities of electrical current applied to the DC motor to move the door to the vent position with the door in the vent position corresponding to the sensor system providing a first signal and to and retract the plunger to the sealed position with the door in the sealed position corresponding to the sensor system providing a second signal.

2. The dishwasher of claim 1 wherein the plunger includes a first end with a latch portion engaging and mechanically coupling with a corresponding latch portion on the door when the door is at the vent position to releasably engage the door to pull the door from the vent position to the sealed position with retraction of the latch to the sealed position.

3. The dishwasher of claim 2 wherein the door includes a handle for mechanically disengaging the door from the first end of the plunger by activation of the handle.

4. The dishwasher of claim 1 wherein the sensor system provides at least three different signals distinguishing a position of the electric actuator among at least three different positions of: the vent position, the sealed position, and a compressed-sealed position with the gasket further compressed from the sealed position.

5. The dishwasher of claim 4 wherein the encoder provides at least one encoding track extending along the elongate section to interact with at least one stationary sensor of the sensor system.

6. The dishwasher of claim 4 wherein the door includes a stop pressing the plunger inward when the door moves from the sealed position to the compressed-sealed position.

7. The dishwasher of claim 4 wherein the DC motor communicates with the pinion gear through a gear train including at least one additional gear and wherein the gear train provides a mechanical play allowing movement of the elongate section without rotation of the DC motor by an amount equal to a distance between the sealed position and the compressed-sealed position.

8. The dishwasher of claim 7 wherein the play is greater than ⅛ inch.

9. The dishwasher of claim 4 further including a controller receiving signals from the encoder to respond to a detection of the electric actuator being in the compressed-sealed position to extend the electric actuator plunger to move the door to the vent position.

10. The dishwasher of claim 9 wherein the controller operates to control the dishwasher and respond to a drying cycle by extending the electric actuator plunger to move the door to the vent position.

11. The dishwasher of claim 4 wherein the plunger provides an excursion of no less than 20 millimeters between the sealed position and the vent position.

12. The dishwasher of claim 1 wherein the DC motor is a synchronous DC motor operating at voltages of less than 24 volts.

13. The dishwasher of claim 1 wherein the DC motor operates to provide at least forty Newtons of force on the plunger in compressing the gasket.

14. The dishwasher of claim 1 further including a door engagement sensor sensing a contact between the plunger and the door.

15. The dishwasher of claim 14 wherein the door engagement sensor is selected from the group consisting of: capacitive sensors, inductive sensors, and photosensors.

16. A dishwasher comprising:

a washing chamber having a door movable from an open position permitting a loading of the washing chamber along an axis, through a vent position providing venting but not loading of the washing chamber, to a sealed position sealing water within the washing chamber by a compression of a gasket;

an electric actuator supported at an upper wall of the washing chamber, the electric actuator having:

a movable plunger having an elongate section extendable to move the door to the vent position, the elongate section supporting a gear rack; and a DC motor communicating through at least one pinion gear with the gear rack to move the plunger along the axis in a first and second direction with different polarities of electrical current applied to the DC motor to move the door to the vent position and retract the plunger to the sealed position; and an encoder providing a signal distinguishing a position of the electric actuator among at least three different positions of: the vent position, the sealed position, and a compressed-sealed position with the gasket further compressed from the sealed position;

wherein the encoder provides at least one encoding track extending along the elongate section to interact with at least one stationary sensor and includes a first and second parallel encoding track interacting with a first and second stationary sensors to provide two separate binary signals, combinations of which uniquely indicate the three different positions.

17. The dishwasher of claim 16 wherein the first and second stationary sensors are light sensors and the encoding tracks very an amount of light received by the light sensors as a function of a position of the elongate section with respect to the light sensors.

18. The dishwasher of claim 16 wherein the first and second stationary sensors mechanically actuated electrical contacts and the encoding tracks provide outwardly extending ridges actuating the first and second sensors as a function of the position of the elongate section with respect to the stationary sensors.

* * * * *